US008996362B2

(12) United States Patent
Nagel et al.

(10) Patent No.: US 8,996,362 B2
(45) Date of Patent: Mar. 31, 2015

(54) DEVICE AND METHOD FOR A BANDWIDTH EXTENSION OF AN AUDIO SIGNAL

(75) Inventors: Frederik Nagel, Nuremberg (DE); Sascha Disch, Fuerth (DE); Max Neuendorf, Nuremberg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 656 days.

(21) Appl. No.: 12/865,096

(22) PCT Filed: Jan. 20, 2009

(86) PCT No.: PCT/EP2009/000329

§ 371 (c)(1),
(2), (4) Date: Nov. 10, 2010

(87) PCT Pub. No.: WO2009/095169

PCT Pub. Date: Aug. 6, 2009

(65) Prior Publication Data

US 2011/0054885 A1 Mar. 3, 2011

Related U.S. Application Data

(60) Provisional application No. 61/025,129, filed on Jan. 31, 2008.

(30) Foreign Application Priority Data

Mar. 26, 2008 (DE) ..... 10 2008 015 702

(51) Int. Cl.
*G10L 19/02* (2013.01)
*G10L 21/038* (2013.01)

(52) U.S. Cl.
CPC ..... *G10L 21/038* (2013.01)
USPC ..... 704/203; 704/500; 704/501; 704/503; 704/504; 704/221

(58) Field of Classification Search
USPC ..... 704/203, 500, 504, 503, 221
See application file for complete search history.

(56) References Cited

U.S. PATENT DOCUMENTS 5,950,153 A 9/1999 Ohmori et al.
6,549,884 B1 4/2003 Laroche et al.

(Continued)

FOREIGN PATENT DOCUMENTS

CN 1272259 11/2000
CN 1828756 9/2006

(Continued)

OTHER PUBLICATIONS

Aarts, R.M. et al.; "A unified approach to low- and high frequency bandwidth extension"; Oct. 2003; 115th AES Convention; New York, USA, 16 pages.

(Continued)

*Primary Examiner* — Qi Han
(74) *Attorney, Agent, or Firm* — Michael A. Glenn; Perkins Coie LLP

(57) ABSTRACT

For a bandwidth extension of an audio signal, in a signal spreader the audio signal is temporally spread by a spread factor greater than 1. The temporally spread audio signal is then supplied to a demicator to decimate the temporally spread version by a decimation factor matched to the spread factor. The band generated by this decimation operation is extracted and distorted, and finally combined with the audio signal to obtain a bandwidth extended audio signal. A phase vocoder in the filterbank implementation or transformation implementation may be used for signal spreading.

21 Claims, 11 Drawing Sheets

(56) References Cited

U.S. PATENT DOCUMENTS

| | | | | |
|---|---|---|---|---|
| 6,680,972 | B1 | 1/2004 | Liljeryd et al. | |
| 6,895,375 | B2 | 5/2005 | Malah et al. | |
| 7,103,088 | B2 | 9/2006 | Misra | |
| 7,680,552 | B2 | 3/2010 | Liljeryd | |
| 2003/0156624 | A1 | 8/2003 | Koslar | |
| 2004/0028244 | A1 * | 2/2004 | Tsushima et al. | 381/98 |
| 2004/0078205 | A1 * | 4/2004 | Liljeryd et al. | 704/503 |
| 2006/0267825 | A1 | 11/2006 | Fujiyama et al. | |

FOREIGN PATENT DOCUMENTS

| | | | |
|---|---|---|---|
| DE | 69821089 | T2 | 11/2004 |
| EP | 1431962 | B1 | 4/2006 |
| JP | 10-313251 | | 11/1998 |
| JP | 11-215006 | | 8/1999 |
| JP | 01-521648 | | 11/2001 |
| JP | 2006119524 | | 5/2006 |
| WO | WO 98/57436 | A | 12/1998 |
| WO | WO 2006/107836 | | 10/2006 |
| WO | WO 2006/107837 | | 10/2006 |
| WO | WO-2006/107837 | | 10/2006 |
| WO | WO 2006/107838 | | 10/2006 |
| WO | WO-2006/107839 | | 10/2006 |
| WO | WO 2007/010817 | | 1/2007 |

OTHER PUBLICATIONS

Bruhnl, et al.; "AMR-WB+: a new audio coding standard for 3rd generation mobile audio services"; ICASSP 2005, pp. Nov. II-1109 through II-1112.

Dietz, M. et al.; Spectral Band Replication, a novel approach in audio coding; May 2002; 112th AES Convention, Munich, Germany, 8 pages.

Dolson, Mark; "The phase vocoder: A Tutorial"; 1986; Computer Music Journal, vol. 10, No. 4, pp. 14-27.

Fastl, et al.; "Psychoacoustics: facts and models"; 1999; Berlin u.a., Springer, pp. 149-173.

Frederik Nagel and Sascha Disch: "A Harmonic Bandwidth Extension Method for Audio Codecs", ICASSP 2009, Apr. 19, 2009-Apr. 24, 2009 pp. 145-148, XP002527507.

Iyengar, V. et al.; "Information technology—Coding of audio-visual objects—Part 3: Audio, Amendment 1: Bandwidth Extension"; Int'l Standard ISO/IEC 14496-3:2001/FDAM 1; "Bandwidth Extension"; Mar. 2003; ISO/IEC, Pattaya, Thailand; 127 pages.

Kallio, L.; "Artificial Bandwidth Extension of Narrowband Speech in Mobile Communication Systems"; Dec. 2002; Master's Thesis, Helsinki University of Technology, Dept. of Electrical and Communications Engineering, Laboratory of Acoustics and Audio Signal Processing, 76 pages.

Kayhko, K.; "A Robust Wideband Enhancement for Narrowband Speech Signal"; 2001, Research Report, Helsinki Univ. of Technology, Laboratory of Acoustics and Audio Signal Processing.

Laroche, "New phase vocoder techniques for pitch-shifting, harmonizing and other exotic effects"; Oct. 17-20, 1999; Proc. 1999 IEEE Workshop on Applications of Signal Processing to Audio and Acoustics; New Paltz, New York, pp. 91-94.

Laroche, L. et al.; "Improved phase vocoder timescale modification of audio"; IEEE Trans. Speech and Audio Processing, vol. 7, No. 3, pp. 323-332, May 1999.

Larsen, E et al.; "Audio Bandwidth Extension—Application to Psychoacoustics, Signal Processing and Loudspeaker Design"; 2004; John Wiley & Sons, Ltd., pp. 146-235.

Larsen, E. et al.; "Efficient high-frequency bandwidth extension of music and speech"; May 2002; 112th AES Convention, Munich, Germany, 5 pages.

Makhoul, J.; Spectral Analysis of Speech by Linear Prediction; Jun. 1973; IEEE Transactions on Audio and Electroacoustics, AU-21(3), pp. 140-148.

Meltzer, S. et al.; "SBR enhanced audio codecs for digital broadcasting such as "Digital Radio Mondiale" (DRM)"; May 2002, 112th AES Convention, Munich, Germany, 4 pages.

Puckette, M.; "Phase-locked Vocoder"; IEEE ASSP Conf. on Applications of Signal Processing to Audio and Acoustics; 1995, Mohonk, 4 pages.

Roebel, A.; "New approach to transient processing in the phase vocoder"; Sep. 8-11, 2003; Proc. of the 6th Int'l Conf. on Digital Audio Effects; London, UK, pp. DAFx-1 through DAFx-6.

Roebel, A.; "Transient detection and preservation in the phase vocoder"; citeseer.ist.psu.edu/679246.html, 4 pagess, 2003.

Yasukawa, H.; "Quality Enhancement of Band Limited Speech by Filtering and Multirate Techniques"; Sep. 1994; In Proc. of Int'l Conf. of Spoken Language Processing (ICSLP); pp. 1607-1610.

Ziegler, T.; "Enhancing mp3 with SBR: Features and Capabilities of the new mp3PROAlgorithm"; May 2002; 112th AES Convention, Munich, Germany, 7 pages.

Crochiere, R. et al., Interpolation and Decimation of Digital Signals—A Tutorial Review, IEEE, vol. 69, No. 3, Mar. 1981.

Geiser, B. et al., Bandwidth Extension for Hierarchical Speech and Audio Coding in ITU-T Tec. G.729.1, IEEE, vol. 15, No. 8, Nov. 2007.

* cited by examiner (filterbank implementation)

(transformation implementation)

(Encoder Side)

(Decoder Side)

DEVICE AND METHOD FOR A BANDWIDTH EXTENSION OF AN AUDIO SIGNAL

CROSS-REFERENCE TO RELATED APPLICATION

This application is a U.S. National Phase entry of PCT/EP2009/000329 filed Jan. 20, 2009, and claims priority to U.S. Patent Application No. 61/025,129 filed Jan. 31, 2008, and also claims period to German Patent Application No. 102008015702.3 filed Mar. 26, 2008, each of which is incorporated herein by references hereto.

BACKGROUND OF THE INVENTION

The present invention relates to the audio signal processing, and in particular, to the audio signal processing in situations in which the available data rate is rather small.

The hearing adapted encoding of audio signals for a data reduction for an efficient storage and transmission of these signals have gained acceptance in many fields. Encoding algorithms are known, in particular, as "MP3" or "MP4". The coding used for this, in particular when achieving lowest bit rates, leads to the reduction of the audio quality which is often mainly caused by an encoder side limitation of the audio signal bandwidth to be transmitted.

It is known from WO 98 57436 to subject the audio signal to a band limiting in such a situation on the encoder side and to encode only a lower band of the audio signal by means of a high quality audio encoder. The upper band, however, is only very coarsely characterized, i.e. by a set of parameters which reproduces the spectral envelope of the upper band. On the decoder side, the upper band is then synthesized. For this purpose, a harmonic transposition is proposed, wherein the lower band of the decoded audio signal is supplied to a filterbank. Filterbank channels of the lower band are connected to filterbank channels of the upper band, or are "patched", and each patched bandpass signal is subjected to an envelope adjustment. The synthesis filterbank belonging to a special analysis filterbank here receives bandpass signals of the audio signal in the lower band and envelope-adjusted bandpass signals of the lower band which were harmonically patched in the upper band. The output signal of the synthesis filterbank is an audio signal extended with regard to its bandwidth, which was transmitted from the encoder side to the decoder side with a very low data rate. In particular, filterbank calculations and patching in the filterbank domain may become a high computational effort.

Complexity-reduced methods for a bandwidth extension of band-limited audio signals instead use a copying function of low-frequency signal portions (LF) into the high frequency range (HF), in order to approximate information missing due to the band limitation. Such methods are described in M. Dietz, L. Liljeryd, K. Kjörling and O. Kunz, "Spectral Band Replication, a novel approach in audio coding," in 112th AES Convention, Munich, May 2002; S. Meltzer, R. Böhm and F. Henn, "SBR enhanced audio codecs for digital broadcasting such as "Digital Radio Mondiale" (DRM)," 112th AES Convention, Munich, May 2002; T. Ziegler, A. Ehret, P. Ekstrand and M. Lutzky, "Enhancing mp3 with SBR: Features and Capabilities of the new mp3PRO Algorithm," in 112th AES Convention, Munich, May 2002; International Standard ISO/IEC 14496-3:2001/FPDAM 1, "Bandwidth Extension," ISO/IEC, 2002, or "Speech bandwidth extension method and apparatus", Vasu Iyengar et al. U.S. Pat. No. 5,455,888.

In these methods no harmonic transposition is performed, but successive bandpass signals of the lower band are introduced into successive filterbank channels of the upper band. By this, a coarse approximation of the upper band of the audio signal is achieved. This coarse approximation of the signal is then in a further step approximated to the original by a post processing using control information gained from the original signal. Here, e.g. scale factors serve for adapting the spectral envelope, an inverse filtering and the addition of a noise carpet for adapting tonality and a supplementation by sinusoidal signal portions, as it is also described in the MPEG-4 Standard.

Apart from this, further methods exist such as the so-called "blind bandwidth extension", described in E. Larsen, R. M. Aarts, and M. Danessis, "Efficient high-frequency bandwidth extension of music and speech", In AES 112th Convention, Munich, Germany, May 2002 wherein no information on the original HF range is used. Further, also the method of the so-called "Artificial bandwidth extension", exists which is described in K. Käyhkö, A Robust Wideband Enhancement for Narrowband Speech Signal; Research Report, Helsinki University of Technology, Laboratory of Acoustics and Audio signal Processing, 2001.

In J. Makinen et al.: AMR-WB+: a new audio coding standard for 3rd generation mobile audio services Broadcasts, IEEE, ICASSP '05, a method for bandwidth extension is described, wherein the copying operation of the bandwidth extension with an up-copying of successive bandpass signals according to SBR technology is replaced by mirroring, for example, by upsampling.

Further technologies for bandwidth extension are described in the following documents. R. M. Aarts, E. Larsen, and O. Ouweltjes, "A unified approach to low- and high frequency bandwidth extension", AES 115th Convention, New York, USA, October 2003; E. Larsen and R. M. Aarts, "Audio Bandwidth Extension—Application to psychoacoustics, Signal Processing and Loudspeaker Design", John Wiley & Sons, Ltd., 2004; E. Larsen, R. M. Aarts, and M. Danessis, "Efficient high-frequency bandwidth extension of music and speech", AES 112th Convention, Munich, May 2002; J. Makhoul, "Spectral Analysis of Speech by Linear Prediction", IEEE Transactions on Audio and Electroacoustics, AU-21(3), June 1973; U.S. patent application Ser. No. 08/951,029; U.S. Pat. No. 6,895,375.

Known methods of harmonic bandwidth extension show a high complexity. On the other hand, methods of complexity-reduced bandwidth extension show quality losses. In particular with a low bitrate and in combination with a low bandwidth of the LF range, artifacts such as roughness and a timber perceived to be unpleasant may occur. A reason for this is the fact that the approximated HF portion is based on a copying operation which leaves harmonic relations of the tonal signal portions unnoticed with regard to each other. This applies both, to the harmonic relation between LF and HF, and also to the harmonic relation within the HF portion itself. With SBR, for example, at the boundary between LF range and the generated HF range, occasionally rough sound impressions occur, as tonal portions copied from the LF range into the HF range, as for example illustrated in FIG. 4*a*, may now in the overall signal encounter tonal portions of the LF range as to be spectrally densely adjacent. Thus, in FIG. 4*a*, an original signal with peaks at 401, 402, 403, and 404 is illustrated, while a test signal is illustrated with peaks at 405, 406, 407, and 408. By copying tonal portions from the LF range into the HF range, wherein in FIG. 4*a* the boundary was at 4250 Hz, the distance of the two left peaks in the test signal is less than the base frequency underlying the harmonic raster, which leads to a perception of roughness.

As the width of tone-compensated frequency groups increases with an increase of the center frequency, as it is described in Zwicker, E. and H. Fastl (1999), Psychoacoustics: Facts and models. Berlin—Springerverlag, sinusoidal portions lying in the LF range in different frequency groups, by copying into the HF range, may come to lie in the same frequency group here, which also leads to a rough hearing impression as it may be seen in FIG. 4*b*. Here it is in particular shown that copying the LF range into the HF range leads to a denser tonal structure in the test signal as compared to the original. The original signal is distributed relatively uniformly across the spectrum in the higher frequency range, as it is in particular shown at 410. In contrast, in particular in this higher range, the test signal 411 is distributed relatively non-uniformly across the spectrum and thus clearly more tonal than the original signal 410.

SUMMARY

According to an embodiment, a device for a bandwidth extension of an audio signal may have: a signal spreader for generating a version of the audio signal as a time signal spread in time by a spread factor >1; a decimator for decimating the temporally spread version of the audio signal by a decimation factor matched to the spread factor; a filter for extracting a distorted signal from the decimated audio signal containing a frequency range which is not contained in the audio signal, or for extracting a signal from the audio signal before a spreading by the signal spreader, wherein the signal contains a frequency range which is not contained in the audio signal after a spreading and decimation, wherein the distorted signal is distorted so that the distorted signal, the decimated audio signal, or the combination signal has a predetermined envelope; and a combiner for combining the distorted or undistorted signal with the audio signal to obtain an audio signal extended in its bandwidth.

According to another embodiment, a method for a bandwidth extension of an audio signal may have the steps of: generating a version of the audio signal as a time signal temporally spread by a spread factor >1; decimating the temporally spread version of the audio signal by the decimation factor which is matched to the spread factor; extracting a distorted signal from the decimated audio signal containing a frequency range which is not contained in the audio signal, or extracting a signal from the audio signal before spreading, the signal containing a frequency range not contained in the audio signal after a spreading and decimation, wherein the distorted signal is distorted so that the extracted signal, the decimated audio signal or the combination signal has a predetermined envelope, and combining the distorted or undistorted signal with the audio signal to obtain an audio signal extended in its bandwidth.

Another embodiment may have a computer program having a program code for performing the above method for a bandwidth extension of an audio signal, when the computer program is executed on a computer.

The inventive concept for a bandwidth extension is based on a temporal signal spreading for generating a version of the audio signal as a time signal which is spread by a spread factor >1 and a subsequent decimation of the time signal to obtain a transposed signal, which may then for example be filtered by a simple bandpass filter to extract a high-frequency signal portion which may only still be distorted or changed with regard to its amplitude, respectively, to obtain a good approximation for the original high-frequency portion. The bandpass filtering may alternatively take place before the signal spreading is performed, so that only the desired frequency range is present after spreading in the spread signal, so that a bandpass filtering after spreading may be omitted.

With the harmonic bandwidth extension on the one hand, problems resulting from a copying or mirroring operation, or both, may be prevented based on a harmonic continuation and spreading of the spectrum using the signal spreader for spreading the time signal. On the other hand, a temporal spreading and subsequent decimation may be executed easier by simple processors than a complete analysis/synthesis filterbank, as it is for example used with the harmonic transposition, wherein additionally decisions have to be made on how patching within the filterbank domain should take place.

For signal spreading, a phase vocoder may be used for which there are implementations of minor effort. In order to obtain bandwidth extensions with factors >2, also several phase-vocoders may be used in parallel, which is advantageous, in particular with regard to the delay of the bandwidth extension which has to be low in real time applications. Alternatively, other methods for signal spreading are available, such as for example the PSOLA method (Pitch Synchronous Overlap Add).

In an embodiment of the present invention, the LF audio signal is first extended in the direction of time with the maximum frequency LFmax with the help of the phase vocoder, i.e. to an integer multiple of the conventional duration of the signal. Hereupon, in a downstream decimator, a decimation of the signal by the factor of the temporal extension takes place which in total leads to a spreading of the spectrum. This corresponds to a transposition of the audio signal. Finally, the resulting signal is bandpass filtered to the range (extension factor−1)·LFmax to extension factor·LFmax. Alternatively, the individual high frequency signals generated by spreading and decimation may be subjected to a bandpass filtering such that in the end they additively overlay across the complete high frequency range (i.e. from LFmax to k*LFmax). This is sensible for the case that still a higher spectral density of harmonics is desired.

The method of harmonic bandwidth extension is executed in an embodiment of the present invention in parallel for several different extension factors. As an alternative to the parallel processing, also a single phase vocoder may be used which is operated serially and wherein intermediate results are buffered. Thus, any bandwidth extension cut-off frequencies may be achieved. The extension of the signal may alternatively also be executed directly in the frequency direction, i.e. in particular by a dual operation corresponding to the functional principle of the phase vocoder.

Advantageously, in embodiments of the invention, no analysis of the signal is necessitated with regard to harmonicity or fundamental frequency.

BRIEF DESCRIPTION OF THE DRAWINGS

In the following, embodiments of the present invention are explained in more detail with reference to the accompanying drawings, in which.

DETAILED DESCRIPTION OF THE INVENTION

Figure 1:
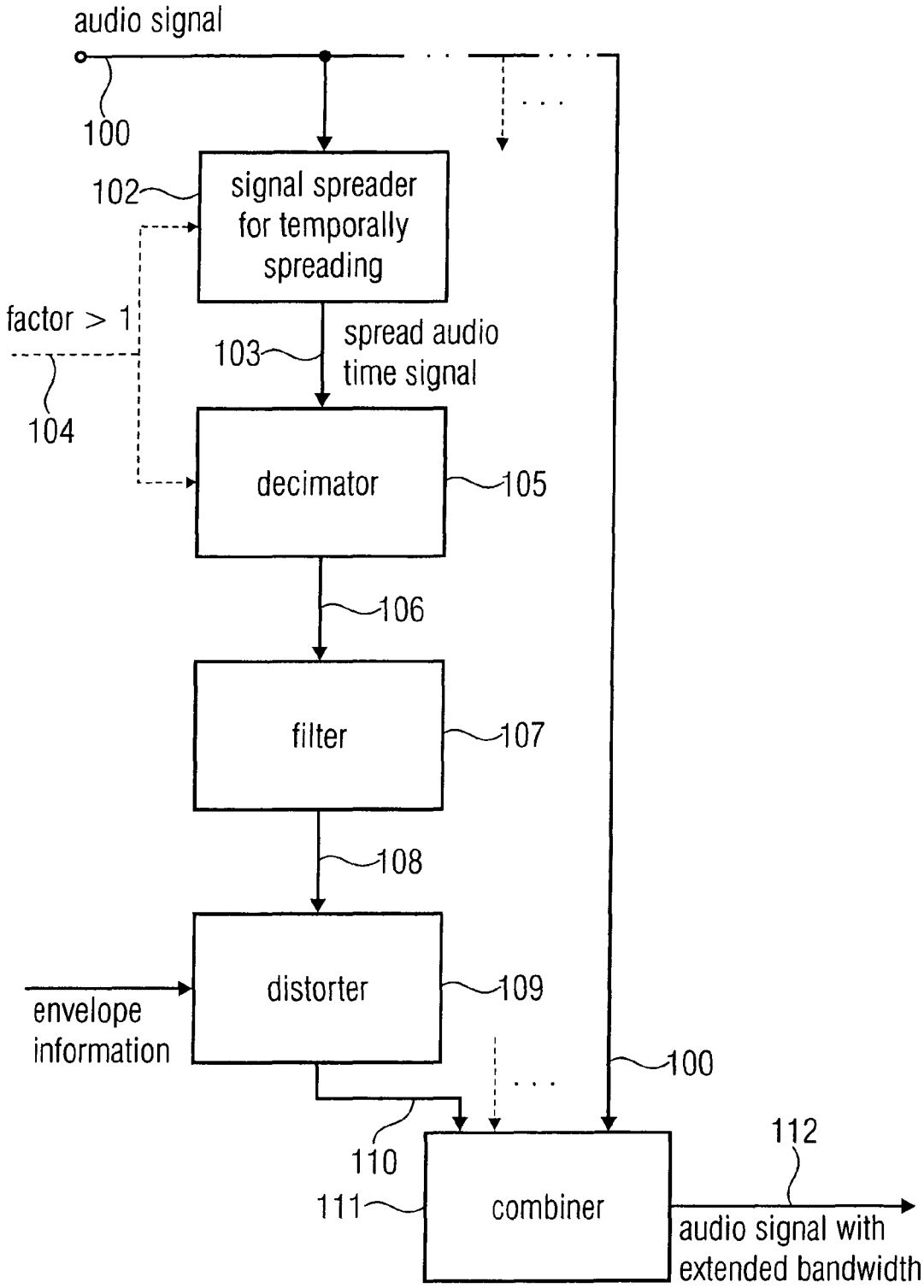
FIG. 1 shows a block diagram of the inventive concept for a bandwidth extension of an audio signal.

FIG. 1 shows a schematical illustration of a device or a method, respectively, for a bandwidth extension of an audio signal. Only exemplarily, FIG. 1 is described as a device, although FIG. 1 may simultaneously also be regarded as the flowchart of a method for a bandwidth extension. Here, the audio signal is fed into the device at an input 100. The audio signal is supplied to a signal spreader 102 which is implemented to generate a version of the audio signal as a time signal spread in time by a spread factor greater than 1. The spread factor in the embodiment illustrated in FIG. 1 is supplied via a spread factor input 104. The spread audio time signal present at an output 103 of the signal spreader 102 is supplied to a decimator 105 which is implemented to decimate the temporally spread audio time signal 103 by a decimation factor matched to the spread factor 104. This is schematically illustrated by the spread factor input 104 in FIG. 1, which is plotted in dashed lines and leads into the decimator 105. In one embodiment, the spread factor in the signal spreader is equal to the inverse of the decimation factor. If, for example, a spread factor of 2.0 is applied in the signal spreader 102, a decimation with a decimation factor of 0.5 is executed. If, however, the decimation is described to the effect that a decimation by a factor of 2 is performed, i.e. that every second sample value is eliminated, then in this illustration, the decimation factor is identical to the spread factor. Alternative ratios between spread factor and decimation factor, for example integer ratios or rational ratios, may also be used depending on the implementation. The maximum harmonic bandwidth extension is achieved, however, when the spread factor is equal to the decimation factor, or to the inverse of the decimation factor, respectively.

In an embodiment of the present invention, the decimator 105 is implemented to, for example, eliminate every second sample (with a spread factor equal to 2) so that a decimated audio signal results which has the same temporal length as the original audio signal 100. Other decimation algorithms, for example, forming weighted average values or considering the tendencies from the past or the future, respectively, may also be used, although, however, a simple decimation may be implemented with very little effort by the elimination of samples. The decimated time signal 106 generated by the decimator 105 is supplied to a filter 107, wherein the filter 107 is implemented to extract a bandpass signal from the decimated audio signal 106, which contains frequency ranges which are not contained in the audio signal 100 at the input of the device. In the implementation, the filter 107 may be implemented as a digital bandpass filter, e.g. as an FIR or IIR filter, or also as an analog bandpass filter, although a digital implementation may be of advantage. Further, the filter 107 is implemented such that it extracts the upper spectral range generated by the operations 102 and 105 wherein, however, the bottom spectral range, which is anyway covered by the audio signal 100, is suppressed as much as possible. In the implementation, the filter 107 may also be implemented such, however, that it also extracts signal portions with frequencies as a bandpass signal contained in the original signal 100, wherein the extracted bandpass signal contains at least one frequency band which was not contained in the original audio signal 100.

The bandpass signal 108, output by the filter 107, is supplied to a distorter 109, which is implemented to distort the bandpass signals so that the bandpass signal comprises a predetermined envelope. This envelope information which may be used for distorting may be input externally, and even come from an encoder or may also be generated internally, for example, by a blind extrapolation from the audio signal 100, or based on tables stored on the decoder side indexed with an envelope of an audio signal 100. The distorted bandpass signal 110 output by the distorter 109 is finally supplied to a combiner 111 which is implemented to combine the distorted bandpass signal 110 to the original audio signal 100 which was also distorted depending on the implementation (the delay stage is not indicated in FIG. 1), to generate an audio signal extended with regard to its bandwidth at an output 112.

In an alternative implementation, the sequence of distorter 109 and combiner 111 is inverse to the illustration indicated in FIG. 1. Here, the filter output signal, i.e. the bandpass signal 108, is directly combined with the audio signal 100, and the distortion of the upper band of the combined signal which is output from the combiner 111 is only executed after combining by the distorter 109. In this implementation, the distorter operates as a distorter for distorting the combination signal so that the combination signal comprises a predetermined envelope. The combiner is in this embodiment thus implemented such that it combines the bandpass signal 108 with the audio signal 100 to obtain an audio signal which is extended regarding its bandwidth. In this embodiment, in which the distortion only takes place after combination, it is of advantage to implement the distorter 109 such that it does not influence the audio signal 100 or the bandwidth of the combination signal, respectively, provided by the audio signal 100, as the lower band of the audio signal was encoded by a high-quality encoder and is, on the decoder side, in the synthesis of the upper band, so to speak the measure of all things and should not be interfered with by the bandwidth extension.

Figure 7A:
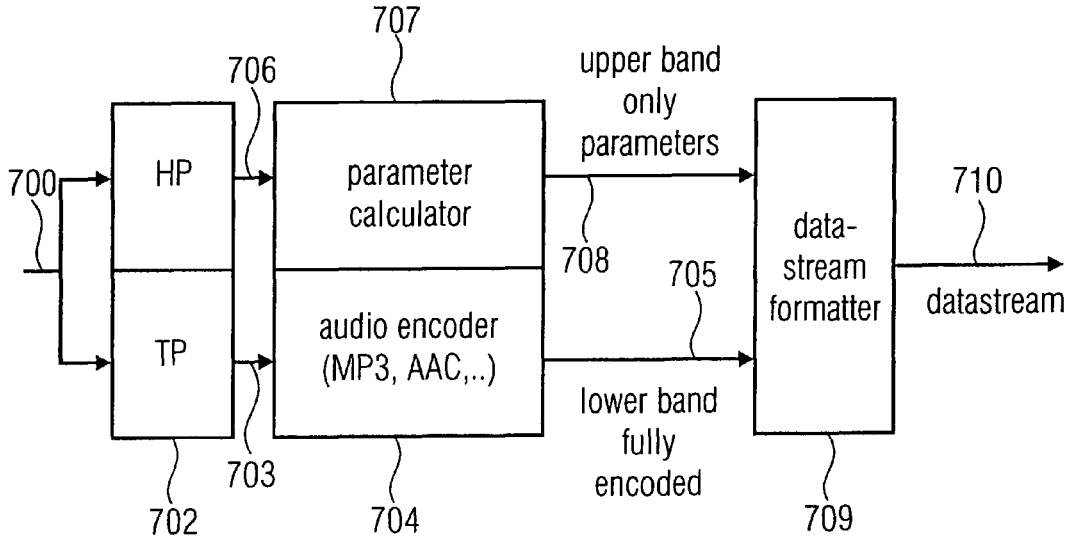
FIG. 7*a* shows a schematical illustration of the encoder side in the context of the bandwidth extension.
Figure 7B:
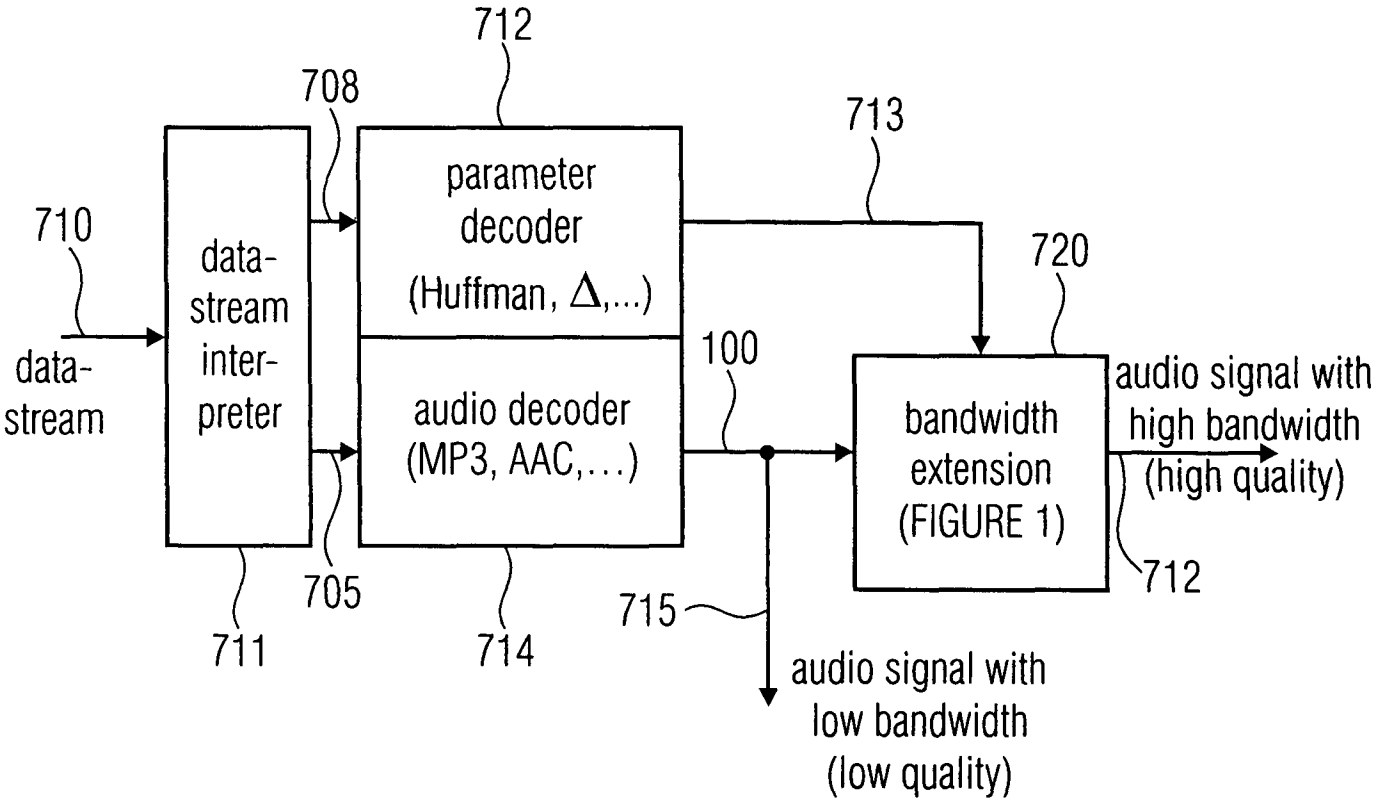
FIG. 7*b* shows a schematical illustration of the decoder side in the context of a bandwidth extension of an audio signal.

Before detailed embodiments of the present invention are illustrated a bandwidth extension scenario is illustrated with reference to FIGS. 7*a* and 7*b*, in which the present invention may be implemented advantageously. An audio signal is fed into a lowpass/highpass combination at an input 700. The lowpass/highpass combination on the one hand includes a lowpass (LP), to generate a lowpass filtered version of the audio signal 700, illustrated at 703 in FIG. 7*a*. This lowpass filtered audio signal is encoded with an audio encoder 704. The audio encoder is, for example, an MP3 encoder (MPEG1 Layer 3) or an AAC encoder, also known as an MP4 encoder and described in the MPEG4 Standard. Alternative audio encoders providing a transparent or advantageously psychoacoustically transparent representation of the band-limited audio signal 703 may be used in the encoder 704 to generate a completely encoded or psychoacoustically encoded and psychoacoustically transparently encoded audio signal 705, respectively. The upper band of the audio signal is output at an output 706 by the highpass portion of the filter 702, designated by "HP". The highpass portion of the audio signal, i.e. the upper band or HF band, also designated as the HF portion, is supplied to a parameter calculator 707 which is implemented to calculate the different parameters. These parameters are, for example, the spectral envelope of the upper band 706 in a relatively coarse resolution, for example, by representation of a scale factor for each psychoacoustic frequency group or for each Bark band on the Bark scale, respectively. A further parameter which may be calculated by the parameter calculator 707 is the noise carpet in the upper band, whose energy per band may be related to the energy of the envelope in this band. Further parameters which may be calculated by the parameter calculator 707 include a tonality measure for each partial band of the upper band which indicates how the spectral energy is distributed in a band, i.e. whether the spectral energy in the band is distributed relatively uniformly, wherein then a non-tonal signal exists in this band, or whether the energy in this band is relatively strongly concentrated at a certain location in the band, wherein then rather a tonal signal exists for this band. Further parameters consist in explicitly encoding peaks relatively strongly protruding in the upper band with regard to their height and their frequency, as the bandwidth extension concept, in the reconstruction without such an explicit encoding of prominent sinusoidal portions in the upper band, will only recover the same very rudimentarily, or not at all.

In any case, the parameter calculator 707 is implemented to generate only parameters 708 for the upper band which may be subjected to similar entropy reduction steps as they may also be performed in the audio encoder 704 for quantized spectral values, such as for example differential encoding, prediction or Huffman encoding, etc. The parameter representation 708 and the audio signal 705 are then supplied to a datastream formatter 709 which is implemented to provide an output side datastream 710 which will typically be a bitstream according to a certain format as it is for example normalized in the MPEG4 Standard.

The decoder side, as it is especially suitable for the present invention, is in the following illustrated with regard to FIG. 7*b*. The datastream 710 enters a datastream interpreter 711 which is implemented to separate the parameter portion 708 from the audio signal portion 705. The parameter portion 708 is decoded by a parameter decoder 712 to obtain decoded parameters 713. In parallel to this, the audio signal portion 705 is decoded by an audio decoder 714 to obtain the audio signal which was illustrated at 100 in FIG. 1.

Depending on the implementation, the audio signal 100 may be output via a first output 715. At the output 715, an audio signal with a small bandwidth and thus also a low quality may then be obtained. For a quality improvement, however, the inventive bandwidth extension 720 is performed, which is for example implemented as it is illustrated in FIG. 1 to obtain the audio signal 112 on the output side with an extended or high bandwidth, respectively, and a high quality.

Figure 2A:
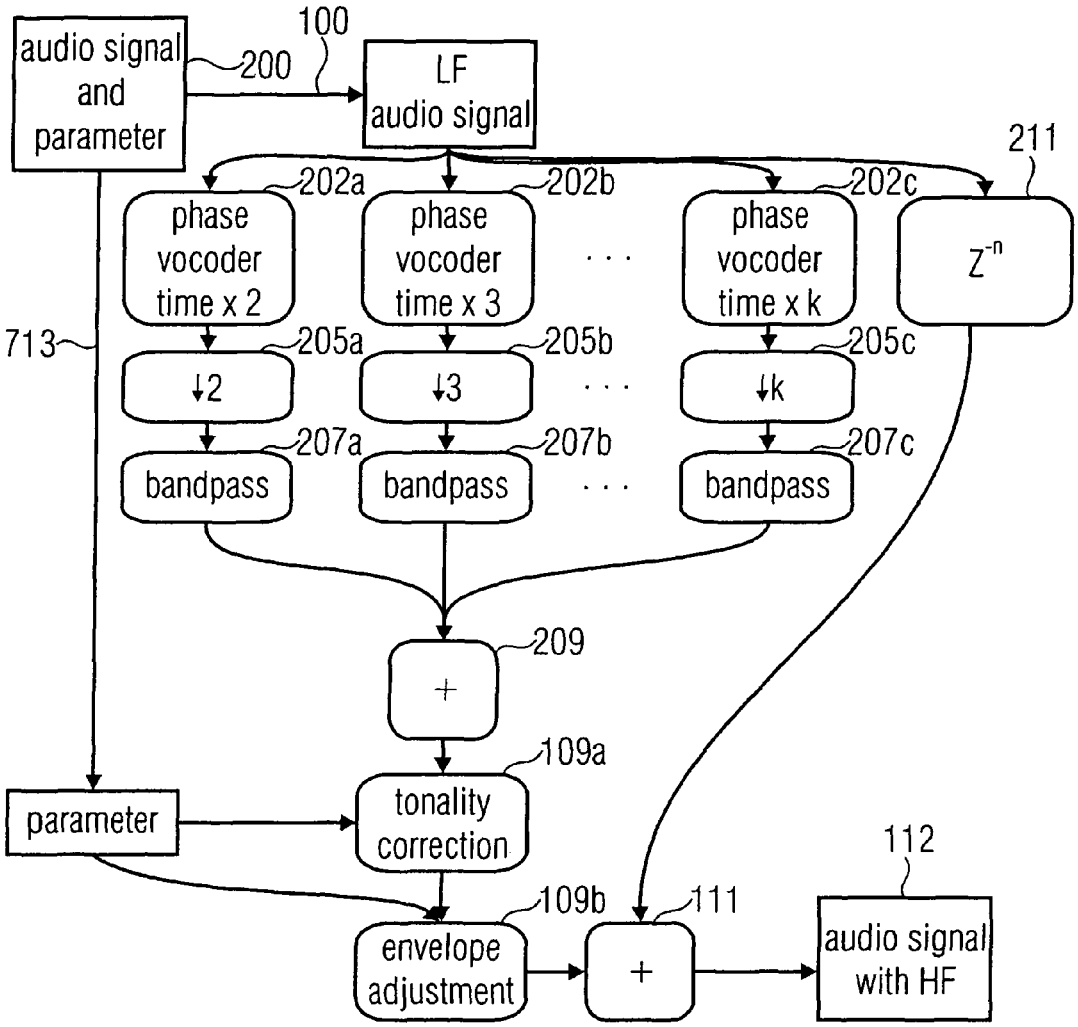
FIG. 2*a* shows a block diagram of a device for a bandwidth extension of an audio signal according to an aspect of the present invention.

In the following, with reference to FIG. 2*a*, an implementation of the bandwidth extension implementation of FIG. 1 is illustrated, which may be used in block 712 of FIG. 7*b*. FIG. 2*a* firstly includes a block designated by "audio signal and parameter", which may correspond to block 711, 712, and 714 of FIG. 7*b*, and is designated by 200. Block 200 provides the output signal 100 as well as decoded parameters 713 on the output side which may be used for different distortions, like for example for a tonality correction 109*a* and an envelope adjustment 109*b*. The signal generated or corrected, respectively, by the tonality correction 109*a* and the envelope adjustment 109*b*, is supplied to the combiner 111 to obtain the audio signal on the output side with an extended bandwidth 112.

The signal spreader 102 of FIG. 1 may be implemented by a phase vocoder 202*a*. The decimator 105 of FIG. 1 may be implemented by a simple sample rate converter 205*a*. The filter 107 for the extraction of a bandpassed signal may be implemented by a simple bandpass filter 107*a*. In particular, the phase vocoder 202*a* and the sample rate decimator 205*a* are operated with a spread factor=2.

A further "train" consisting of the phase vocoder 202*b*, decimator 205*b* and bandpass filter 207*b* may be provided to extract a further bandpass signal at the output of the filter 207*b*, comprising a frequency range between the upper cut-off frequency of the bandpass filter 207*a* and three times the maximum frequency of the audio signal 100.

In addition to this, a k-phase vocoder 202*c* is provided achieving a spreading of the audio signal by the factor k, wherein k is an integer number greater than 1. A decimator 205 is connected downstream to the phase vocoder 202*c*, which decimates by the factor k. Finally, the decimated signal is supplied to a bandpass filter 207*c* which is implemented to have a lower cut-off frequency which is equal to the upper cut-off frequency of the adjacent branch and which has an upper cut-off frequency which corresponds to the k-fold of the maximum frequency of the audio signal 100. All bandpass signals are combined by a combiner 209, wherein the combiner 209 may for example be implemented as an adder. Alternatively, the combiner 209 may also be implemented as a weighted adder which, depending on the implementation, attenuates higher bands more strongly than lower bands, independent of the downstream distortion by the elements 109*a*, 109*b*. In addition to this, the system illustrated in FIG. 2*a* includes a delay stage 211 which guarantees that a synchronized combination takes place in the combiner 111 which may for example be a sample-wise addition.

Figure 3:
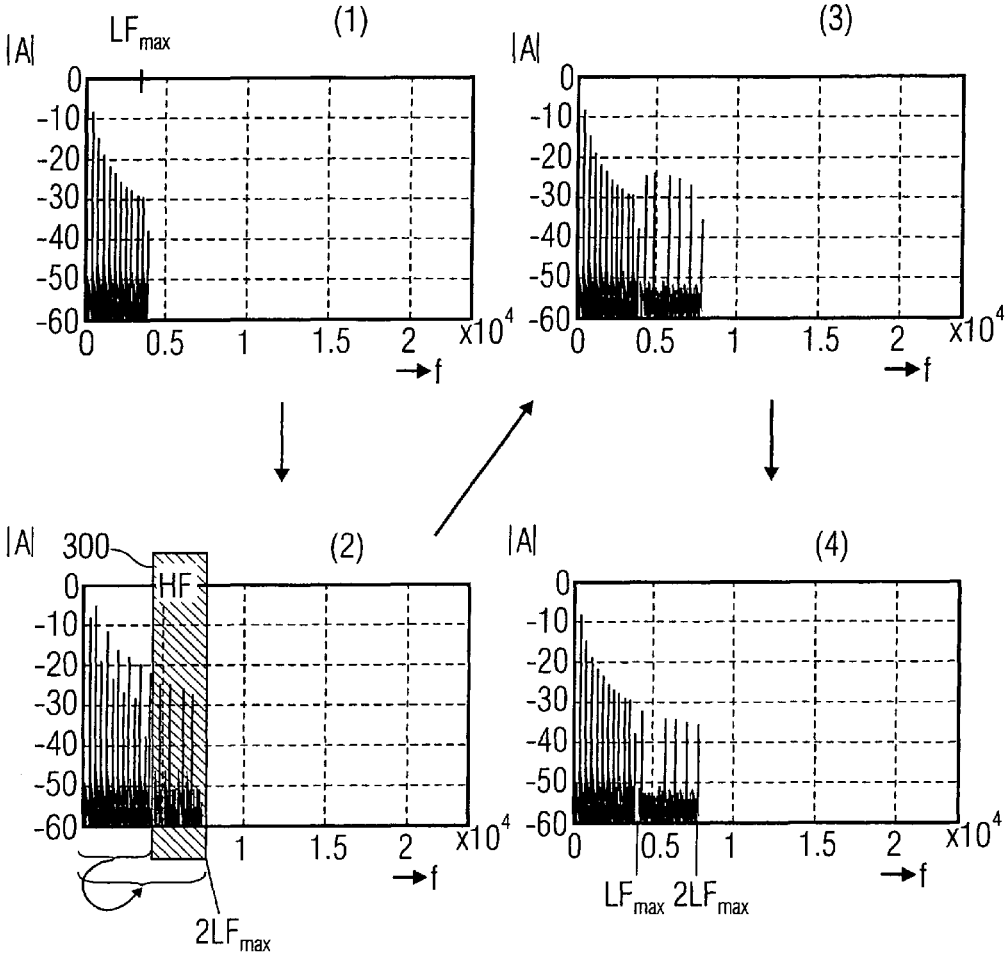
FIG. 3 shows a schematical illustration of the signal processing using spectrums at certain points in time of an inventive bandwidth extension.
Figure 4A:
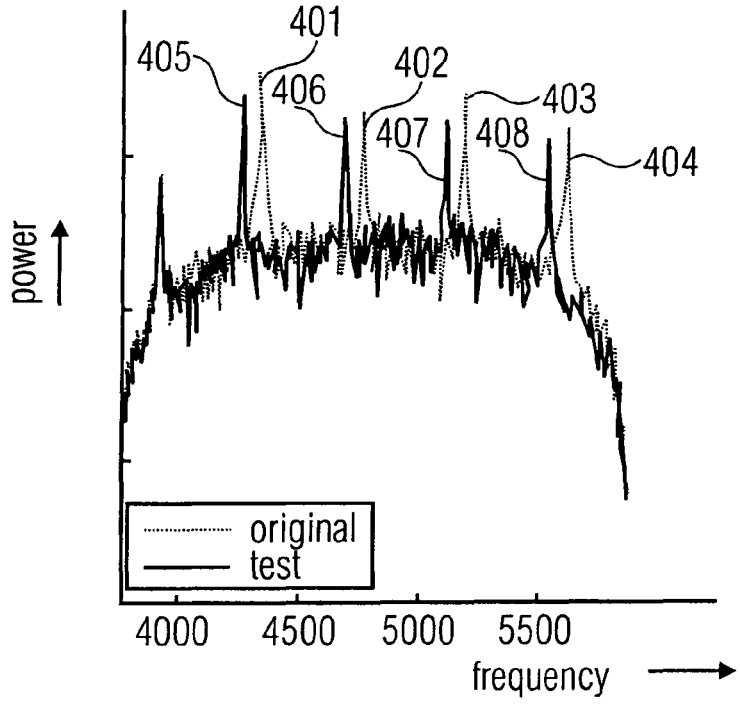
FIG. 4*a* shows a comparison between an original signal and a test signal providing a rough sound impression.
Figure 4B:
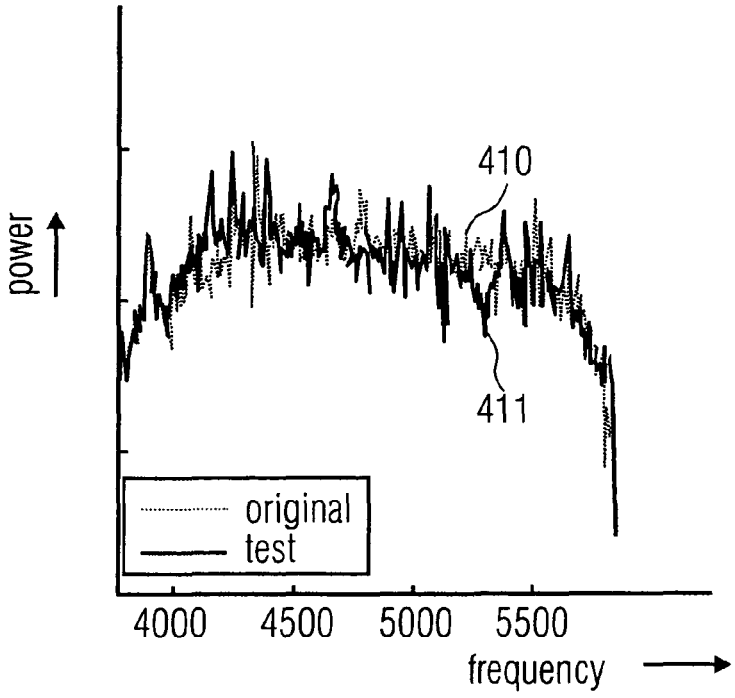
FIG. 4*b* shows a comparison of an original signal to a test signal also leading to a rough auditory impression.

FIG. 3 shows a schematical illustration of different spectrums which may occur in the processing illustrated in FIG. 1 or FIG. 2*a*. The partial image (1) of FIG. 3 shows a band-limited audio signal as it is for example present at 100 in FIG. 1, or 703 in FIG. 7*a*. This signal may be spread by the signal spreader 102 to an integer multiple of the original duration of the signal and subsequently decimated by the integer factor, which leads to an overall spreading of the spectrum as it is illustrated in the partial image (2) of FIG. 3. The HF portion is illustrated in FIG. 3, as it is extracted by a bandpass filter comprising a passband 300. In the third partial image (3), FIG. 3 shows the variants in which the bandpass signal is already combined with the original audio signal 100 before the distortion of the bandpass signal. Thus, a combination spectrum with an undistorted bandpass signal results, wherein then, as indicated in the partial image (4), a distortion of the upper band, but if possible, no modification of the lower band takes place to obtain the audio signal 112 with an extended bandwidth.

The LF signal in the partial image (1) has the maximum frequency LFmax. The phase vocoder 202*a* performs a transposition of the audio signal such that the maximum frequency of the transposed audio signal is 2LFmax. Now, the resulting signal in the partial image (2) is bandpass filtered to the range LFmax to 2LFmax. Generally seen, when the spread factor is designated by k (k>1), the bandpass filter comprises a passband of (k−1)·LFmax to k·LFmax). The procedure illustrated in FIG. 3 is repeated for different spread factors, until the desired highest frequency k·LFmax is achieved, wherein k=the maximum extension factor kmax.

Figure 5A:
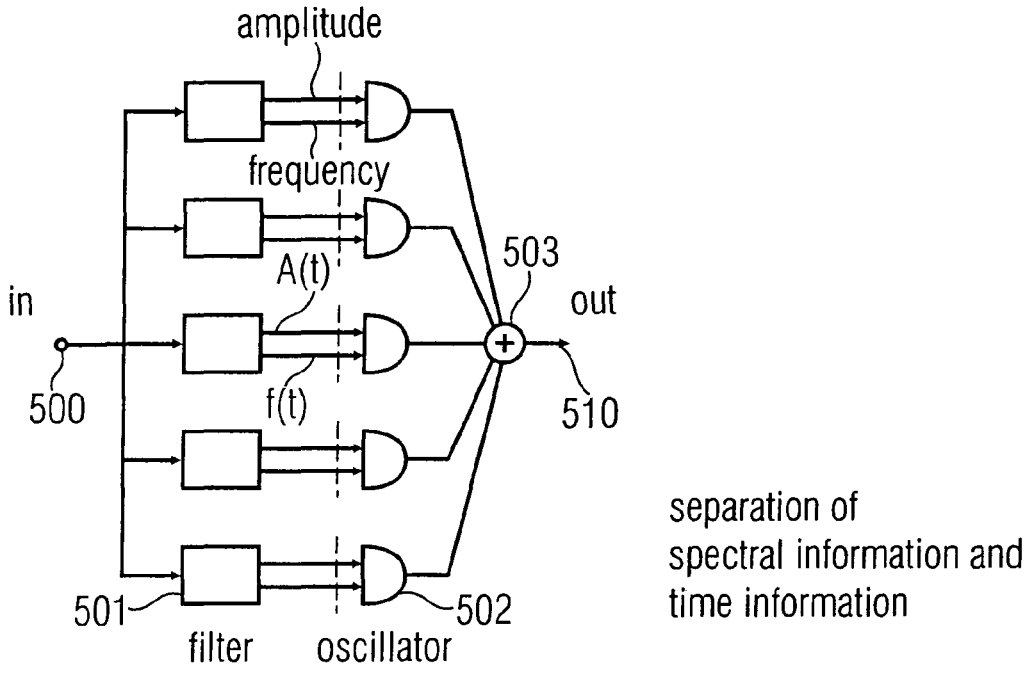
FIG. 5*a* shows a schematical illustration of the filterbank implementation of a phase vocoder.

In the following, with reference to FIGS. 5 and 6, implementations for a phase vocoder 202*a*, 202*b*, 202*c* are illustrated according to the present invention. FIG. 5*a* shows a filterbank implementation of a phase vocoder, wherein an audio signal is fed in at an input 500 and obtained at an output 510. In particular, each channel of the schematic filterbank illustrated in FIG. 5*a* includes a bandpass filter 501 and a downstream oscillator 502. Output signals of all oscillators from every channel are combined by a combiner, which is for example implemented as an adder and indicated at 503, in order to obtain the output signal. Each filter 501 is implemented such that it provides an amplitude signal on the one hand and a frequency signal on the other hand. The amplitude signal and the frequency signal are time signals illustrating a development of the amplitude in a filter 501 over time, while the frequency signal represents a development of the frequency of the signal filtered by a filter 501.

Figure 5B:
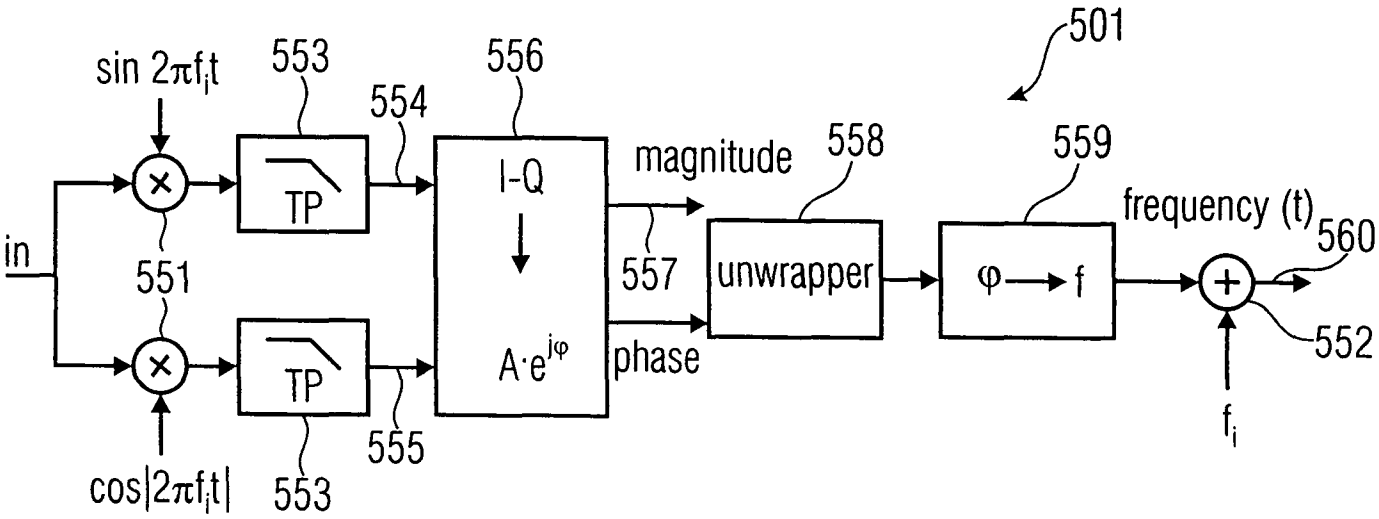
FIG. 5*b* shows a detailed illustration of a filter of FIG. 5*a;*

A schematical setup of filter 501 is illustrated in FIG. 5*b*. Each filter 501 of FIG. 5*a* may be set up as in FIG. 5*b*, wherein, however, only the frequencies fi supplied to the two input mixers 551 and the adder 552 are different from channel to channel. The mixer output signals are both lowpass filtered by lowpasses 553, wherein the lowpass signals are different insofar as they were generated by local oscillator frequencies (LO frequencies), which are out of phase by 90°. The upper lowpass filter 553 provides a quadrature signal 554, while the lower filter 553 provides an in-phase signal 555. These two signals, i.e. I and Q, are supplied to a coordinate transformer 556 which generates a magnitude phase representation from the rectangular representation. The magnitude signal or amplitude signal, respectively, of FIG. 5*a* over time is output at an output 557. The phase signal is supplied to a phase unwrapper 558. At the output of the element 558, there is no phase value present any more which is between 0 and 360°, but a phase value which increases linearly. This "unwrapped" phase value is supplied to a phase/frequency converter 559 which may for example be implemented as a simple phase difference former which subtracts a phase of a previous point in time from a phase at a current point in time to obtain a frequency value for the current point in time. This frequency value is added to the constant frequency value fi of the filter channel i to obtain a temporarily varying frequency value at the output 560. The frequency value at the output 560 has a direct component=fi and an alternating component=the frequency deviation by which a current frequency of the signal in the filter channel deviates from the average frequency fi.

Thus, as illustrated in FIGS. 5*a* and 5*b*, the phase vocoder achieves a separation of the spectral information and time information. The spectral information is in the special channel or in the frequency fi which provides the direct portion of the frequency for each channel, while the time information is contained in the frequency deviation or the magnitude over time, respectively.

Figure 5C:
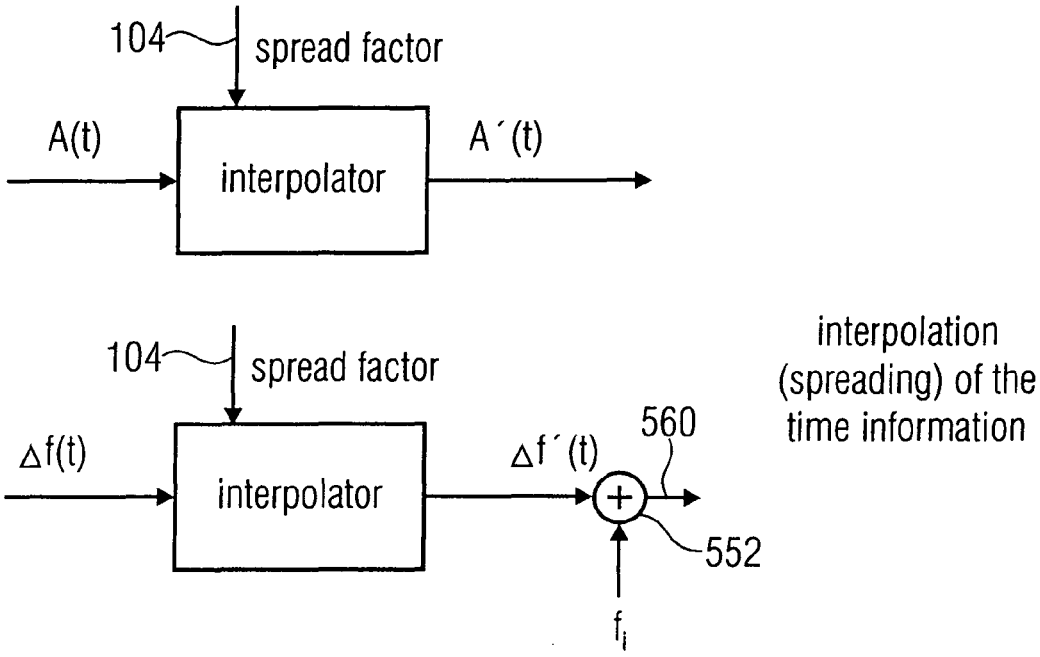
FIG. 5*c* shows a schematical illustration for the manipulation of the magnitude signal and the frequency signal in a filter channel of FIG. 5*a;*

FIG. 5*c* shows a manipulation as it is executed for the bandwidth increase according to the invention, in particular, in the phase vocoder 202*a*, and in particular, at the location of the illustrated circuit plotted in dashed lines in FIG. 5*a*.

For time scaling, e.g. the amplitude signals A(t) in each channel or the frequency of the signals f(t) in each signal may be decimated or interpolated, respectively. For purposes of transposition, as it is useful for the present invention, an interpolation, i.e. a temporal extension or spreading of the signals A(t) and f(t) is performed to obtain spread signals A'(t) and f'(t), wherein the interpolation is controlled by the spread factor 104, as it was illustrated in FIG. 1. By the interpolation of the phase variation, i.e. the value before the addition of the constant frequency by the adder 552, the frequency of each individual oscillator 502 in FIG. 5*a* is not changed. The temporal change of the overall audio signal is slowed down, however, i.e. by the factor 2. The result is a temporally spread tone having the original pitch, i.e. the original fundamental wave with its harmonics.

By performing the signal processing illustrated in FIG. 5*c*, wherein such a processing is executed in every filter band channel in FIG. 5, and by the resulting temporal signal then being decimated in the decimator 105 of FIG. 1, or in the decimator 205*a* in FIG. 5*a*, respectively, the audio signal is shrunk back to its original duration while all frequencies are doubled simultaneously. This leads to a pitch transposition by the factor 2 wherein, however, an audio signal is obtained which has the same length as the original audio signal, i.e. the same number of samples.

As an alternative to the filterband implementation illustrated in FIG. 5*a*, a transformation implementation of a phase vocoder may also be used. Here, the audio signal 100 is fed into an FFT processor, or more generally, into a Short-Time-Fourier-Transformation-Processor 600 as a sequence of time samples. The FFT processor 600 is implemented schematically in FIG. 6 to perform a time windowing of an audio signal in order to then, by means of an FFT, calculate both a magnitude spectrum and also a phase spectrum, wherein this calculation is performed for successive spectrums which are related to blocks of the audio signal, which are strongly overlapping.

In an extreme case, for every new audio signal sample a new spectrum may be calculated, wherein a new spectrum may be calculated also e.g. only for each twentieth new sample. This distance a in samples between two spectrums may be given by a controller 602. The controller 602 is further implemented to feed an IFFT processor 604 which is implemented to operate in an overlapping operation. In particular, the IFFT processor 604 is implemented such that it performs an inverse short-time Fourier Transformation by performing one IFFT per spectrum based on a magnitude spectrum and a phase spectrum, in order to then perform an overlap add operation, from which the time range results. The overlap add operation eliminates the effects of the analysis window.

A spreading of the time signal is achieved by the distance b between two spectrums, as they are processed by the IFFT processor 604, being greater than the distance a between the spectrums in the generation of the FFT spectrums. The basic idea is to spread the audio signal by the inverse FFTs simply being spaced apart further than the analysis FFTs. As a result, spectral changes in the synthesized audio signal occur more slowly than in the original audio signal.

Without a phase rescaling in block 606, this would, however, lead to frequency artifacts. When, for example, one single frequency bin is considered for which successive phase values by 45° are implemented, this implies that the signal within this filterband increases in the phase with a rate of ⅛ of a cycle, i.e. by 45° per time interval, wherein the time interval here is the time interval between successive FFTs. If now the inverse FFTs are being spaced farther apart from each other, this means that the 45° phase increase occurs across a longer time interval. This means that the frequency of this signal portion was unintentionally reduced. To eliminate this artifact frequency reduction, the phase is resealed by exactly the same factor by which the audio signal was spread in time. The phase of each FFT spectral value is thus increased by the factor b/a, so that this unintentional frequency reduction is eliminated.

Figure 6:
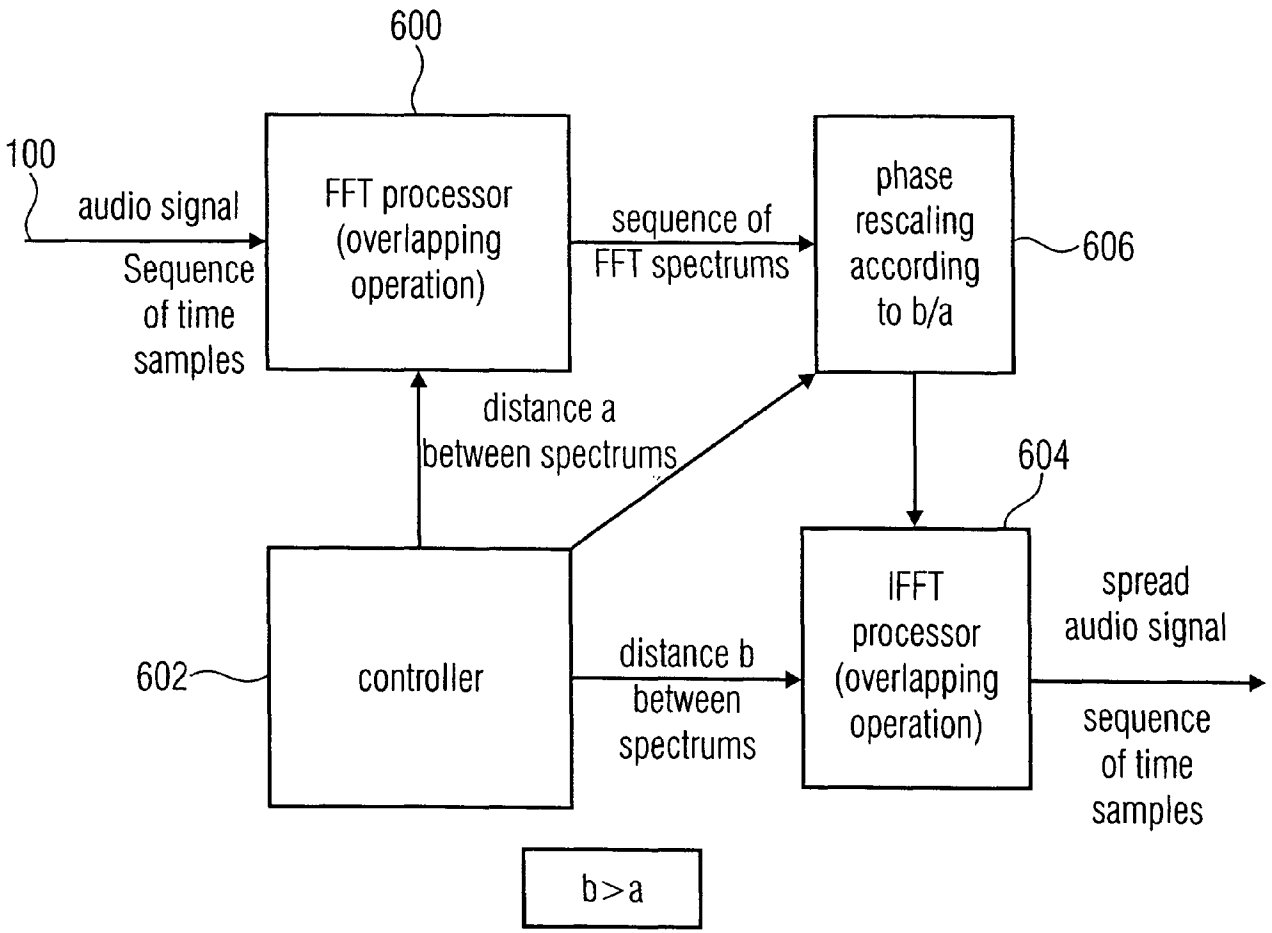
FIG. 6 shows a schematical illustration of the transformation implementation of a phase vocoder.

While in the embodiment illustrated in FIG. 5*c* the spreading by interpolation of the amplitude/frequency control signals was achieved for one signal oscillator in the filterbank implementation of FIG. 5*a*, the spreading in FIG. 6 is achieved by the distance between two IFFT spectrums being greater than the distance between two FFT spectrums, i.e. b being greater than a, wherein, however, for an artifact prevention a phase resealing is executed according to b/a.

With regard to a detailed description of phase-vocoders reference is made to the following documents:

"The phase Vocoder: A tutorial", Mark Dolson, Computer Music Journal, vol. 10, no. 4, pp. 14-27, 1986, or "New phase Vocoder techniques for pitch-shifting, harmonizing and other exotic effects", L. Laroche and M. Dolson, Proceedings 1999 IEEE Workshop on applications of signal processing to audio and acoustics, New Paltz, N.Y., Oct. 17-20, 1999, pages 91 to 94; "New approached to transient processing interphase vocoder", A. Röbel, Proceeding of the 6th international conference on digital audio effects (DAFx-03), London, UK, Sep. 8-11, 2003, pages DAFx-1 to DAFx-6; "Phase-locked Vocoder", Meller Puckette, Proceedings 1995, IEEE ASSP, Conference on applications of signal processing to audio and acoustics, or U.S. Pat. No. 6,549,884.

Figure 2B:
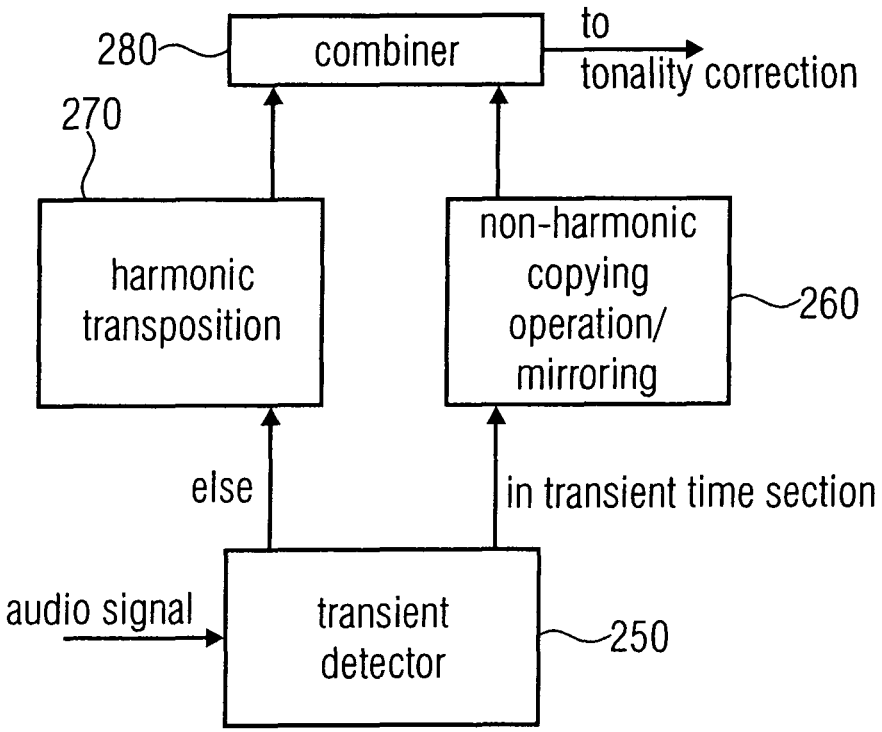
FIG. 2*b* shows an improvement of the concept of FIG. 2*a* with transient detectors.

FIG. 2*b* shows an improvement of the system illustrated in FIG. 2*a*, wherein a transient detector 250 is used which is implemented to determine whether a current temporal operation of the audio signal contains a transient portion. A transient portion consists in the fact that the audio signal changes a lot in total, i.e. that e.g. the energy of the audio signal changes by more than 50% from one temporal portion to the next temporal portion, i.e. increases or decreases. The 50% threshold is only an example, however, and it may also be smaller or greater values. Alternatively, for a transient detection, the change of energy distribution may also be considered, e.g. in the conversion from a vocal to sibilant.

If a transient portion of the audio signal is determined, the harmonic transposition is left, and for the transient time range, a switch it a non-harmonic copying operation or a non-harmonic mirroring or some other bandwidth extension algorithm is executed, as it is illustrated at 260. If it is then again detected that the audio signal is no longer transient, a harmonic transposition is again performed, as illustrated by the elements 102, 105 in FIG. 1. This is illustrated at 270 in FIG. 2*b*.

The output signals of blocks 270 and 260 which arrive offset in time due to the fact that a temporal portion of the audio signal may be either transient or non-transient, are supplied to a combiner 280 which is implemented to provide a bandpass signal over time which may, e.g., be supplied to the tonality correction in block 109*a* in FIG. 2*a*. Alternatively, the combination by block 280 may for example also be performed after the adder 111. This would mean, however, that for a whole transformation block of the audio signal, a transient characteristic is assumed, or if the filterbank implementation also operates based on blocks, for a whole such block a decision in favor of either transient or non-transient, respectively, is made.

As a phase vocoder 202*a*, 202*b*, 202*c*, as illustrated in FIG. 2*a* and explained in more detail in FIGS. 5 and 6, generates more artifacts in the processing of transient signal portions than in the processing of non-transient signal portions, a switch is performed to a non-harmonic copying operation or mirroring, as it was illustrated in FIG. 2*b* at 260. Alternatively, also a phase reset to the transient may be performed, as it is for example described in the experts publication by Laroche cited above, or in the U.S. Pat. No. 6,549,884.

As it has already been indicated, in blocks 109*a*, 109*b*, after the generation of the HF portion of the spectrum, a spectral formation and an adjustment to the original measure of noise is performed. The spectral formation may take place, e.g. with the help of scale factors, dB(A)-weighted scale factors or a linear prediction, wherein there is the advantage in the linear prediction that no time/frequency conversion and no subsequent frequency/time conversion is necessitated.

The present invention is advantageous insofar that by the use of the phase vocoder, a spectrum with an increasing frequency is further spread and is correctly harmonically continued by the integer spreading. Thus, the result of coarsenesses at the cut-off frequency of the LF range is excluded and interferences by too densely occupied HF portions of the spectrum are prevented. Further, efficient phase vocoder implementations may be used, which and may be done without filterbank patching operations.

Alternatively, other methods for signal spreading are available, such as, for example, the PSOLA method (Pitch Synchronous Overlap Add). Pitch Synchronous Overlap Add, in short PSOLA, is a synthesis method in which recordings of speech signals are located in the database. As far as these are periodic signals, the same are provided with information on the fundamental frequency (pitch) and the beginning of each period is marked. In the synthesis, these periods are cut out with a certain environment by means of a window function, and added to the signal to be synthesized at a suitable location: Depending on whether the desired fundamental frequency is higher or lower than that of the database entry, they are combined accordingly denser or less dense than in the original. For adjusting the duration of the audible, periods may be omitted or output in double. This method is also called TD-PSOLA, wherein TD stands for time domain and emphasizes that the methods operate in the time domain. A further development is the MultiBand Resynthesis OverLap Add method, in short MBROLA. Here the segments in the database are brought to a uniform fundamental frequency by a pre-processing and the phase position of the harmonic is normalized. By this, in the synthesis of a transition from a segment to the next, less perceptive interferences result and the achieved speech quality is higher.

In a further alternative, the audio signal is already bandpass filtered before spreading, so that the signal after spreading and decimation already contains the desired portions and the subsequent bandpass filtering may be omitted. In this case, the bandpass filter is set so that the portion of the audio signal which would have been filtered out after bandwidth extension is still contained in the output signal of the bandpass filter. The bandpass filter thus contains a frequency range which is not contained in the audio signal 106 after spreading and decimation. The signal with this frequency range is the desired signal forming the synthesized high-frequency signal. In this embodiment, the distorter 109 will not distort a bandpass signal, but a spread and decimated signal derived from a bandpass filtered audio signal.

It is further to be noted, that the spread signal may also be helpful in the frequency range of the original signal, e.g. by mixing the original signal and spread signal, thus no "strict" passband is necessitated. The spread signal may then well be mixed with the original signal in the frequency band in which it overlaps with the original signal regarding frequency, to modify the characteristic of the original signal in the overlapping range.

It is further to be noted that the functionalities of distorting 109 and filtering 107 may be implemented in one single filter block or in two cascaded separate filters. As distorting takes place depending on the signal, the amplitude characteristic of this filter block will be variable. Its frequency characteristic is, however, independent of the signal.

Depending on the implementation, as illustrated in FIG. 1, first the overall audio signal may be spread, decimated, and then filtered, wherein filtering corresponds to the operations of the elements 107, 109. Distorting is thus executed after or simultaneously to filtering, wherein for this purpose a combined filter/distorter block in the form of a digital filter is suitable. Alternatively, before the (bandpass-) filtering (107) a distortion may take place here when two different filter elements are used.

Again, alternatively, a bandpass filtering may take place before spreading so that only the distortion (109) follows after the decimation. For these functions two different elements are of advantage here.

Again alternatively, also in all variants above, the distortion may take place after the combination of the synthesis signal with the original audio signal such as, for example, with a filter which has no, or only very little effect, on the signal to be filtered in the frequency range of the original filter, which, however, generates the desired envelope in the extended frequency range. In this case, again two different elements may be used for extraction and distortion.

The inventive concept is suitable for all audio applications in which the full bandwidth is not available. In the propagation of audio contents such as, for example, by digital radio, Internet streaming and in audio communication applications, the inventive concept may be used.

Depending on the circumstances, the inventive method may be implemented for analyzing an information signal in hardware or in software. The implementation may be executed on a digital storage medium, in particular a floppy disc or a CD, having electronically readable control signals stored thereon, which may cooperate with the programmable computer system, such that the method is performed. Generally, the invention thus consists in a computer program product with a program code for executing the method stored on a machine-readable carrier, when the computer program product is executed on a computer. In other words, the invention may thus be realized as a computer program having a program code for performing the method, when the computer program is executed on a computer.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. A device for a bandwidth extension of an audio signal, comprising:

a signal spreader for generating a version of the audio signal as a time signal spread in time by a spread factor of 2 to obtain a first spread signal that has a doubled time-length of the audio signal and the same sampling rate;

a second signal spreader implemented to spread the audio signal by a factor of 3 to obtain a second spread signal that has a tripled time-length of the audio signal and the same sampling rate;

a first decimator for decimating the first spread signal by a decimation factor of 2 to obtain a first decimated audio signal that has the same time-length of the audio signal and a doubled sampling rate;

a second decimator implemented to decimate the second spread signal by a decimation factor of 3 to obtain a second decimated audio signal that has the same time-length of the audio signal and a tripled sampling rate;

a filter for extracting a first extracted signal from the first decimated audio signal, wherein the first extracted signal comprises a frequency range which is not comprised in the audio signal wherein a distortion is applied so that the first extracted signal, the first decimated signal, or a combination signal obtained by a combiner comprises a predetermined envelope;

a bandpass filter implemented to extract a second extracted signal having a band from the second decimated audio signal, wherein the second extracted signal contains a frequency range which is not contained in the audio signal; and a combiner for adding the first and second extracted signals or distorted extracted signals and the audio signal to achieve the combination signal extended in its bandwidth by a factor of 2 and a factor of 3 wherein at least one of the first signal spreader, the second signal spreader, the first decimator, the second decimator, the filter, the bandpass filter and the combiner comprises a hardware implementation.

2. The device according to claim 1, wherein the signal spreader or the further signal spreader is implemented to spread the audio signal so that a pitch of the audio signal is not changed.

3. The device according to claim 1, wherein the signal spreader or the further signal spreader is implemented to spread the audio signal so that a temporal duration of the audio signal is increased and that a bandwidth of the first spread audio signal or a bandwidth of the second spread audio signal is equal to a bandwidth of the audio signal.

4. The device according to claim 1, wherein the signal spreader or the further signal spreader comprises a phase vocoder.

5. The device according to claim 4, wherein the phase vocoder is implemented in a filterbank or in a Fourier Transformer implementation.

6. The device according to claim 1, wherein a further group of a further phase vocoder, a downstream decimator, and a downstream bandpass filter is present which are set to a spread factor different from 2 or 3, to generate a further bandpass signal which may be supplied to the adder.

7. The device according to claim 1, wherein the signal spreader or the further signal spreader is implemented to output a time signal as a sequence of samples which comprises the full bandwidth of the audio signal, and wherein the decimator or the further decimator is implemented to obtain the sequence of samples as an input signal and to decimate the same.

8. The device according to claim 1, wherein the filter comprises a distorter implemented to execute a distortion based on transmitted parameters.

9. The device according to claim 1, further comprising:

a transient detector implemented to control the signal spreader or the decimator when a transient portion is detected in the audio signal, to execute a non-harmonic copying operation or a mirroring operation for generating higher spectral portions.

10. The device according to claim 1, further comprising:

a tonality/noise correction module which is implemented to manipulate a tonality or noise of the bandpass signal or a distorted bandpass signal.

11. The device according to claim 1, wherein the signal spreader comprises a plurality of filter channels, wherein each filter channel comprises is configured for generating a temporally varying magnitude signal and a temporally varying frequency signal and an oscillator, wherein each filter channel comprises an interpolator for interpolating the temporally varying magnitude signal, to achieve an interpolated, temporally varying magnitude signal by the spread factor, or for interpolating the temporally varying frequency signal by the spread factor to achieve an interpolated temporally varying frequency signal, and wherein the oscillator of each filter channel is implemented to be controlled by the interpolated temporally varying magnitude signal or by the interpolated temporally varying frequency signal.

12. The device according to claim 1, wherein the signal spreader comprises:

an FFT processor for generating successive spectrums for overlapping blocks of temporal samples of the audio signal, wherein the overlapping blocks are spaced apart from each other by a first time distance;

an IFFT processor for transforming successive spectrums from a frequency range into the time range to generate overlapping blocks of time samples spaced apart from each other by a second time distance which is greater than the first time distance; and a phase re-scaler for rescaling the phases of the spectral values of the sequences of generated FFT spectrums according to a ratio of the first time distance and the second time distance.

13. A method for a bandwidth extension of an audio signal, comprising:

spreading the audio signal to obtain a first spread signal being temporally spread by a spread factor of 2 to obtain a first spread signal that has a doubled time-length of the audio signal and the same sampling rate;

further spreading the audio signal by a factor of 3 to obtain a second spread signal that has a tripled time-length of the audio signal and the same sampling rate;

decimating the first spread signal by a decimation factor of 2 to obtain a first decimated signal that has the same time-length of the audio signal and a doubled sampling rate;

further decimating the second spread signal by a decimation factor of 3 to obtain a second decimated signal that has the same time-length of the audio signal and a tripled sampling rate;

extracting a first extracted signal from the first decimated signal, wherein the first extracted signal comprises a frequency range which is not comprised in the audio signal, wherein a distortion is applied so that the first extracted signal, the first decimated signal or a combination signal obtained by a step of combining comprises a predetermined envelope;

extracting a second extracted signal having a band from the second decimated audio signal, wherein the second extracted signal contains a frequency range which is not contained in the audio signal; and combining the first extracted signal and the second extracted signal or distorted extracted signals with the audio signal to obtain a combination signal extended in its bandwidth by a factor of 2 and a factor of 3.

14. A non-transitory storage medium having stored thereon a computer program comprising a program code for performing, when the computer program is executed on a computer, a method for a bandwidth extension of an audio signal, the method comprising:

spreading the audio signal to obtain a first spread signal being temporally spread by a spread factor of 2 to obtain a first spread signal that has a doubled time-length of the audio signal and the same sampling rate;

further spreading the audio signal by a factor of 3 to obtain a second spread signal that has a tripled time-length of the audio signal and the same sampling rate;

decimating the first spread signal by a decimation factor of 2 to obtain a first decimated signal that has the same time-length of the audio signal and a doubled sampling rate;

further decimating the second spread signal by a decimation factor of 3 to obtain a second decimated signal that has the same time-length of the audio signal and a tripled sampling rate;

extracting a first extracted signal from the first decimated audio signal, wherein the first extracted signal comprises a frequency range which is not comprised in the audio signal wherein a distortion is applied so that the first extracted signal, the first decimated signal or a combination signal obtained by a step of combining comprises a predetermined envelope;

extracting a second extracted signal having a band from the second decimated audio signal, wherein the second extracted signal contains a frequency range which is not contained in the audio signal; and combining the first extracted signal and the second extracted signal or distorted extracted signals with the audio signal to obtain a combination signal extended in its bandwidth by a factor of 2 and a factor of 3.

15. A device for a bandwidth extension of an audio signal, comprising:

a first signal spreader for generating a version of the audio signal as a time signal spread in time by a spread factor of 2 to obtain a first spread signal that has a doubled time-length of the audio signal and the same sampling rate;

a second signal spreader implemented to spread the signal by a factor of 3 to obtain a second spread signal that has a tripled time-length of the audio signal and the same sampling rate;

a first decimator for decimating the first spread signal by a decimation factor of 2 to obtain a first decimated signal that has the same time-length of the audio signal and a doubled sampling rate;

a second decimator implemented to decimate the second spread signal by a decimation factor of 3 to obtain a second decimated signal that has the same time-length of the audio signal and a tripled sampling rate;

a filter for extracting a first extracted signal from the audio signal before a spreading by the first signal spreader, wherein the first extracted signal is spread by the first signal spreader and decimated by the first decimator to obtain the first decimated signal, the first decimated signal containing a frequency range which is not contained in the audio signal, wherein a distortion is applied so that the first extracted signal, the first decimated signal, or a combination signal obtained by a combiner comprises a predetermined envelope, a bandpass filter implemented to extract a second extracted signal by executing a filtering before a spreading by the second signal spreader, wherein the second extracted signal is spread by the second signal spreader and decimated by the second decimator to obtain the second decimated signal, the second decimated signal containing a frequency range which is not contained in the audio signal;

a combiner for adding the first and second extracted signal or distorted extracted signals with the audio signal to obtain the combination signal extended in its bandwidth by a factor of 2 and a factor of 3, wherein at least one of the first signal spreader, the second signal spreader, the first decimator, the second decimator, the filter, the bandpass filter and the combiner comprises a hardware implementation.

16. A device for a bandwidth extension of an audio signal, comprising:

a first signal spreader for generating a version of the audio signal as a time signal spread in time by a spread factor of 2 to obtain a first spread signal that has a doubled time-length of the audio signal and the same sampling rate;

a second signal spreader implemented to spread the signal by a factor of 3 to obtain a second spread signal that has a tripled time-length of the audio signal and the same sampling rate;

a first decimator for decimating the first spread signal by a decimation factor of 2 to obtain a first decimated signal that has the same time-length of the audio signal and a doubled sampling rate;

a second decimator implemented to decimate the second spread signal by a decimation factor of 3 to obtain a second decimated signal that has the same time-length of the audio signal and a tripled sampling rate;

a filter for extracting a first extracted signal from the first decimated signal containing a frequency range which is not contained in the audio signal, wherein a distortion is applied so that the first extracted signal, the first decimated signal, or a combination signal obtained by a combiner comprises a predetermined envelope, a bandpass filter implemented to extract a second extracted signal by executing a filtering before a spreading by the second signal spreader, wherein the second extracted signal is spread by the second signal spreader and decimated by the second decimator to obtain the second decimated signal, the second decimated signal containing a frequency range which is not contained in the audio signal;

a combiner for adding the first and second extracted signal or distorted extracted signals with the audio signal to obtain the combination signal extended in its bandwidth by a factor of 2 and a factor of 3, wherein at least one of the first signal spreader, the second signal spreader, the first decimator, the second decimator, the filter, the bandpass filter and the combiner comprises a hardware implementation.

17. A device for a bandwidth extension of an audio signal, comprising:

a first signal spreader for generating a version of the audio signal as a time signal spread in time by a spread factor of 2 to obtain a first spread signal that has a doubled time-length of the audio signal and the same sampling rate;

a second signal spreader implemented to spread the signal by a factor of 3 to obtain a second spread signal that has a tripled time-length of the audio signal and the same sampling rate;

a first decimator for decimating the first spread signal by a decimation factor of 2 to obtain a first decimated signal that has the same time-length of the audio signal and a doubled sampling rate;

a second decimator implemented to decimate the second spread signal by a decimation factor of 3 to obtain a second decimated signal that has the same time-length of the audio signal and a tripled sampling rate;

a filter for extracting a first extracted signal from the audio signal before a spreading by the first signal spreader, wherein the first extracted signal is spread by the first signal spreader and decimated by the first decimator to obtain the first decimated signal, the first decimated signal containing a frequency range which is not contained in the audio signal, wherein a distortion is applied so that the first extracted signal, the first decimated signal, or a combination signal obtained by a combiner comprises a predetermined envelope, a bandpass filter implemented to extract a second extracted signal having a band from the second decimated signal which is new with regard to the first decimated signal;

a combiner for adding the first and second extracted signal or distorted extracted signals with the audio signal to obtain the combination signal extended in its bandwidth by a factor of 2 and a factor of 3, wherein at least one of the first signal spreader, the second signal spreader, the first decimator, the second decimator, the filter, the bandpass filter and the combiner comprises a hardware implementation.

18. A method for a bandwidth extension of an audio signal, comprising:

generating a version of the audio signal as a time signal temporally spread by a spread factor of 2 to obtain a first spread signal that has a doubled time-length of the audio signal and the same sampling rate;

spreading the audio signal by a factor of 3 to obtain a second spread signal that has a tripled time-length of the audio signal and the same sampling rate;

decimating the first spread signal by a decimation factor of 2 to obtain a first decimated signal that has the same time-length of the audio signal and a doubled sampling rate;

decimating the second spread signal by a decimation factor of 3 to obtain a second decimated signal that has the same time-length of the audio signal and a tripled sampling rate;

extracting, by a filter, a first extracted signal from the audio signal before generating the version, wherein the first extracted signal is spread by the generating the version and decimated by the decimating the first spread signal to obtain the first decimated signal, the first decimated signal containing a frequency range which is not contained in the audio signal, wherein a distortion is applied so that the first extracted signal, the first decimated signal or a combination signal obtained by a step of combining comprises a predetermined envelope, extracting a second extracted signal by executing a filtering before a spreading the audio signal by a factor of 3, wherein the second extracted signal is spread by the spreading the audio signal by a factor of 3 and decimated by the decimating the second spread signal by a decimation factor of 3 to obtain the second decimated signal, the second decimated signal containing a frequency range which is not contained in the audio signal;

combining the first and second extracted signals or distorted extracted signals with the audio signal to obtain the combination signal extended in its bandwidth by a factor of 2 and a factor of 3.

19. A method for a bandwidth extension of an audio signal, comprising:

generating a version of the audio signal as a time signal temporally spread by a spread factor of 2 to obtain a first spread signal that has a doubled time-length of the audio signal and the same sampling rate;

spreading the audio signal by a factor of 3 to obtain a second spread signal that has a tripled time-length of the audio signal and the same sampling rate;

decimating the first spread signal by a decimation factor of 2 to obtain a first decimated signal that has the same time-length of the audio signal and a doubled sampling rate;

decimating the second spread signal by a decimation factor of 3 to obtain a second decimated signal that has the same time-length of the audio signal and a tripled sampling rate;

extracting, by a filter, a first extracted signal from the first decimated signal containing a frequency range which is not contained in the audio signal, wherein a distortion is applied so that the first extracted signal, the first decimated signal or a combination signal obtained by a step of combining comprises a predetermined envelope, extracting a second extracted signal by executing a filtering before a spreading the audio signal by a factor of 3, wherein the second extracted signal is spread by the spreading the audio signal by a factor of 3 and decimated by the decimating the second spread signal by a decimation factor of 3 to obtain the second decimated signal, the second decimated signal containing a frequency range which is not contained in the audio signal;

combining the first and second extracted signals or distorted extracted signals with the audio signal to obtain the combination signal extended in its bandwidth by a factor of 2 and a factor of 3.

20. A method for a bandwidth extension of an audio signal, comprising:

generating a version of the audio signal as a time signal temporally spread by a spread factor of 2 to obtain a first spread signal that has a doubled time-length of the audio signal and the same sampling rate;

spreading the audio signal by a factor of 3 to obtain a second spread signal that has a tripled time-length of the audio signal and the same sampling rate;

decimating the first spread signal by a decimation factor of 2 to obtain a first decimated signal that has the same time-length of the audio signal and a doubled sampling rate;

decimating the second spread signal by a decimation factor of 3 to obtain a second decimated signal that has the same time-length of the audio signal and a tripled sampling rate;

extracting, by a filter, a first extracted signal from the audio signal before generating the version, wherein the first extracted signal is spread by the generating the version and decimated by the decimating the first spread signal to obtain the first decimated signal, the first decimated signal containing a frequency range which is not contained in the audio signal, wherein a distortion is applied so that the first extracted signal, the first decimated signal or a combination signal obtained by a step of combining comprises a predetermined envelope, extracting a second extracted signal having a band from the second decimated signal which is new with regard to the first decimated signal;

combining the first and second extracted signals or distorted extracted signals with the audio signal to obtain the combination signal extended in its bandwidth by a factor of 2 and a factor of 3.

21. A non-transitory storage medium having stored thereon a computer program comprising a program code for performing, when the computer program is executed on a computer, a method of any one of the claim 18, 19, or 20.

* * * * *